United States Patent [19]

Dewey et al.

[11] Patent Number: 4,663,838

[45] Date of Patent: May 12, 1987

[54] INSERTION TOOL TIPS

[75] Inventors: James D. Dewey, Plymouth; Matthew G. Pedersen, Mound; Larry W. Gonier, Inver Grove Heights, all of Minn.

[73] Assignee: ADC Telecommunications, Inc., Minneapolis, Minn.

[21] Appl. No.: 800,998

[22] Filed: Nov. 22, 1985

Related U.S. Application Data

[63] Continuation-in-part of Ser. No. 789,470, Oct. 21, 1985, abandoned.

[51] Int. Cl.[4] ..... H01R 43/04

[52] U.S. Cl. ..... 29/751; 29/280; 29/758

[58] Field of Search ..... 29/278, 280, 751, 758; 7/107, 170; 81/124.1; 279/79, 80

[56] References Cited

U.S. PATENT DOCUMENTS

| | | | |
|---|---|---|---|
| 2,397,026 | 3/1946 | Marker et al. | 279/79 |
| 2,596,594 | 5/1952 | Petre | 279/79 |
| 4,161,061 | 7/1979 | Mason et al. | 29/278 |

FOREIGN PATENT DOCUMENTS

| | | | |
|---|---|---|---|
| 127967 | 3/1902 | Fed. Rep. of Germany | 279/79 |

*Primary Examiner*—Percy W. Echols

*Attorney, Agent, or Firm*—Merchant, Gould, Smith, Edell, Welter & Schmidt

[57] ABSTRACT

A wire insertion tool for use with split cylinder terminals includes a shaft having a wire insertion post sized to fit within a split cylinder terminal and a sleeve fixed to the shaft with the tip of the sleeve sized to fit around the outside of the wire insertion terminal. A spring biased sliding sleeve is concentrically disposed between the tip of the shaft and the tip of the fixed sleeve. The sliding sleeve is displaceable by the walls of the split cylinder as a wire is inserted, and is spring biased outwardly to eject wire debris as the tool is extracted. Jamming of the tool by wire insertion debris is thereby avoided. A member is provided for removably interlocking the tool and a handle. A cam follower is secured to the handle and a cam surface is provided on an end of the tool for the tool to be locked into the handle when forced in one direction and released when forced in another.

8 Claims, 11 Drawing Figures

FIG. 1
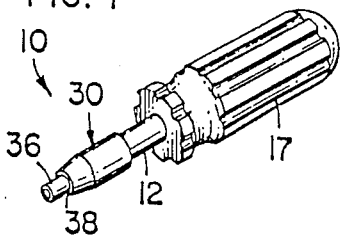
FIG. 2
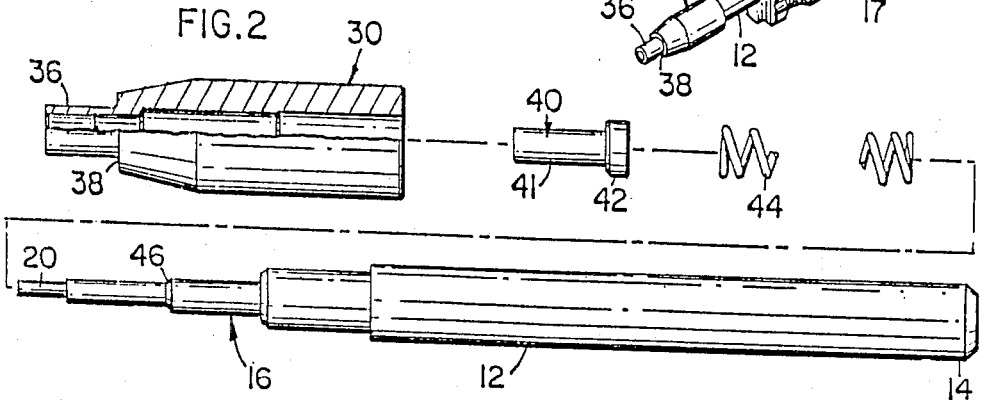
FIG. 3
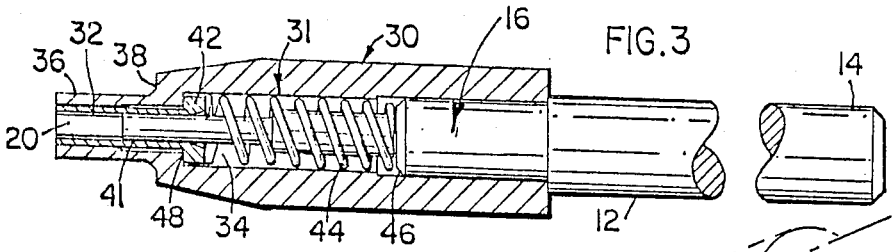
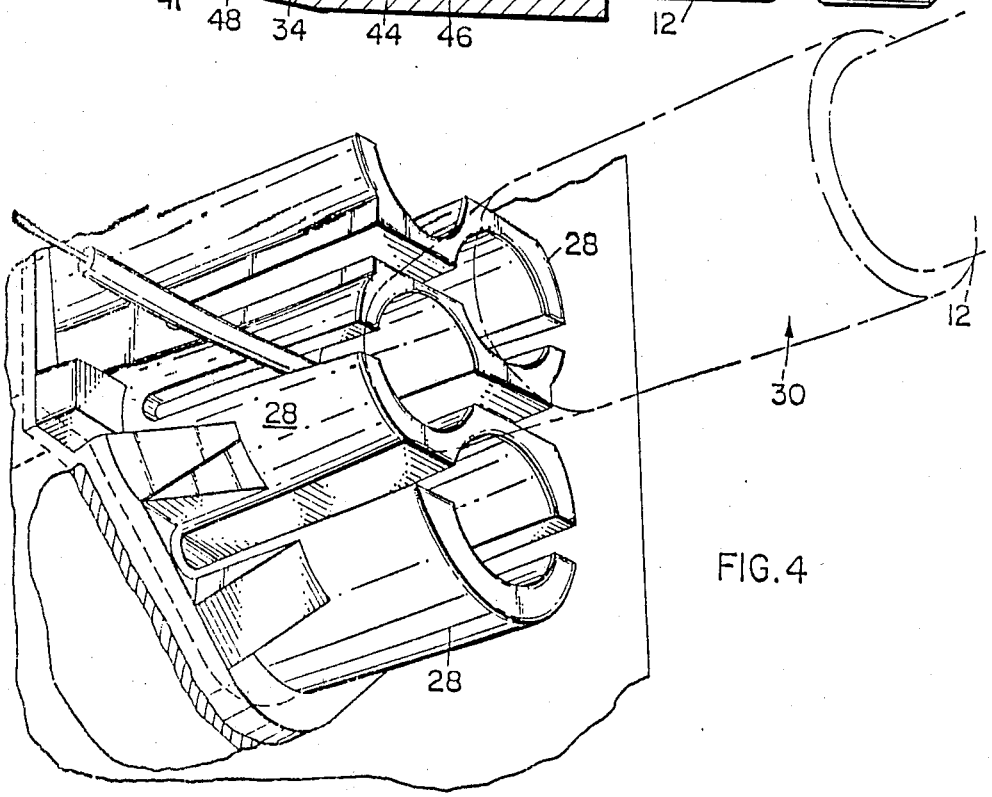
FIG. 4

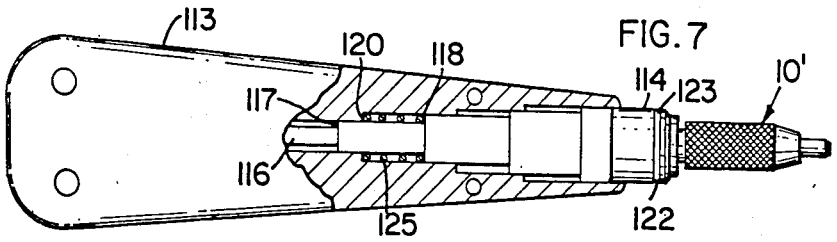
FIG. 7
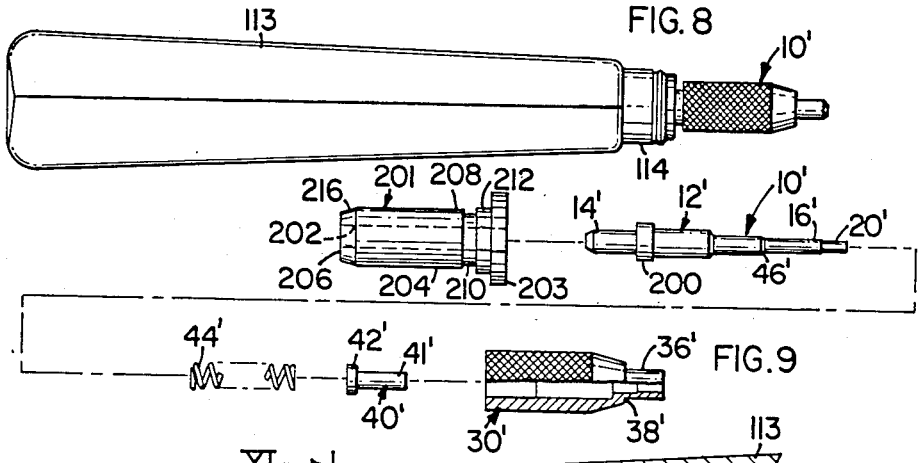
FIG. 8
FIG. 9
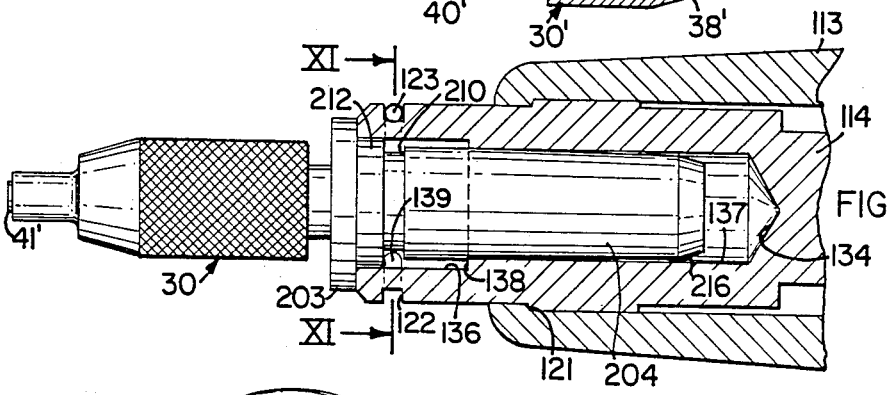
FIG. 10
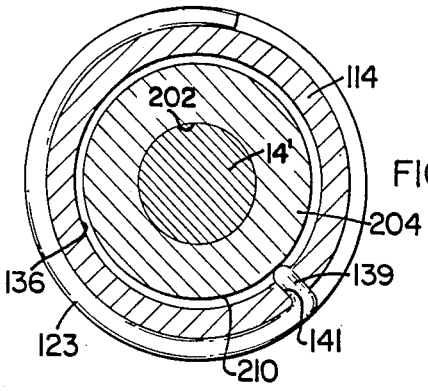
FIG. 11

INSERTION TOOL TIPS

This is a continuation-in-part of commonly assigned U.S. patent application Ser. No. 789,470 filed Oct. 21, 1985, now abandoned, and entitled "Debris Ejecting Wire Inserting Tool".

TECHNICAL FIELD OF THE INVENTION

The present invention pertains generally to the field of terminal connecting blocks and more particularly to insulation displacement terminals.

BACKGROUND OF THE INVENTION

Split cylinder insulation displacement terminals are used in the telecommunications industry to interconnect equipment and distribution lines. The terminals provide for a quick, mechanically secure and electrically sound connection without the use of solder or wire wrapping tools. An example of a terminal block or module of this nature may be seen in co-pending U.S. patent application Ser. No. 658,268, entitled "Electrical Connector Module with Multiple Connector Housings", by Pohl. As illustrated in the Pohl application, each insulation displacement terminal includes a seam or slot including wire piercing edges which cut through the insulation as the wire is slid into the slot and a trimming edge radially opposite the seam or slot which cuts the excess length from a wire as it is installed.

Also disclosed in the Pohl application is a wire insertion tool which is used to insert a wire in an insulation displacement terminal. As described in that application in detail, the tool includes a central shaft which has a tip portion sized to fit inside the terminal and an outer cylindrical sleeve member sized to fit around the terminal in between the terminal and the terminal housing. The Pohl tool further includes an aperture through the sleeve member whereby plastic and metal residue which works its way up into the tool's tip during an insertion operation may escape, thereby avoiding jamming the tool.

The present invention provides an improved wire insertion tool in which plastic and metal debris is positively ejected from the tool after each insertion operation.

SUMMARY OF THE INVENTION

The present invention provides a debris ejecting insertion tool including a cylindrical shaft having a handle end and an insertion end. The insertion end includes at the tip thereof an insertion post having a diameter slightly less than the inside diameter of a terminal and a spring stop shoulder spaced apart therefrom. A cylindrical sleeve member is fixed about the insertion end of the shaft to form an annularly shaped cavity including a first extent, or portion, concentrically disposed about the insertion tip portion of the shaft, including the insertion post, and a second portion of greater diameter extending from the first portion to the shoulder of the shaft. A sliding ejector sleeve is provided and is disposed in part between the insertion tip of the shaft and the fixed sleeve in the first portion of the cavity. The sliding ejector sleeve includes a head portion sized to fit within the second portion of the cavity. A spring is provided, and it is disposed between the head of the ejector sleeve and the shaft shoulder to spring bias the ejector sleeve against a shoulder formed in the fixed sleeve at the junction of the first and second cavity portions. Accordingly, during an insertion operation the ejection sleeve engages the terminal and is pushed backwards into the tool as a wire is inserted. Thus, any debris that works in its way in between the insertion tip of the shaft and the insertion end of the fixed sleeve is ejected by the ejector sleeve as the tool is removed.

BRIEF DESCRIPTION OF THE DRAWING

FIG. 1 is a perspective view of the wire insertion tool of the present invention;

FIG. 2 is an exploded view of the wire insertion tool according to the present invention;

FIG. 3 is an enlarged cross-sectional view of the insertion end portion of the wire insertion tool according to the present invention;

FIG. 4 is a perspective view of an insulation displacement terminal module showing the wire insertion tool of the present invention in phantom outline;

FIG. 7 is a partial sectional plan view of a tool in a handle;

FIG. 8 is a side elevational view of a tool;

FIG. 9 is an exploded view of a wire insertion tool according to an alternative embodiment of the present invention;

FIG. 10 is a sectional view of the end of the handle showing the tool inserted within the handle; and FIG. 11 is a sectional view along the line XI—XI of FIG. 10.

DETAILED DESCRIPTION OF THE INVENTION

Figure 5:
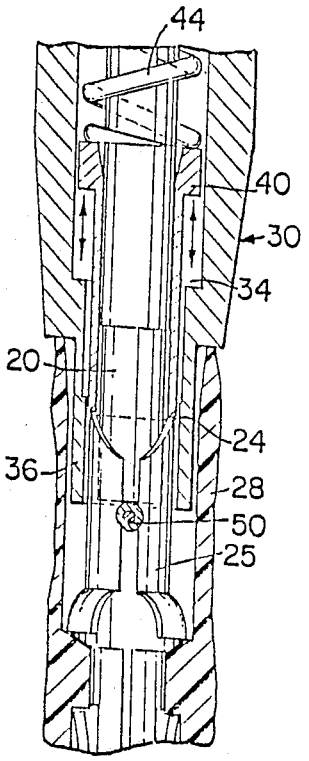
FIG. 5 is a cross-sectional view showing the tool of the present invention as used to insert a wire in an insulation displacement terminal.

Referring now to the various figures of the drawing, throughout which like elements have been given like reference numerals, the structure of the debris ejecting wire insertion tool of the prsent invention will be explained. Wire insertion tool 10 includes a shaft 12 having a handle end 14 and a wire insertion end 16. According to the disclosed embodiment of the invention, a screwdriver like handle 17 is fixed to the handle end of shaft 12. However, if desired an impact type handle may be substituted for handle 17.

Figure 6:
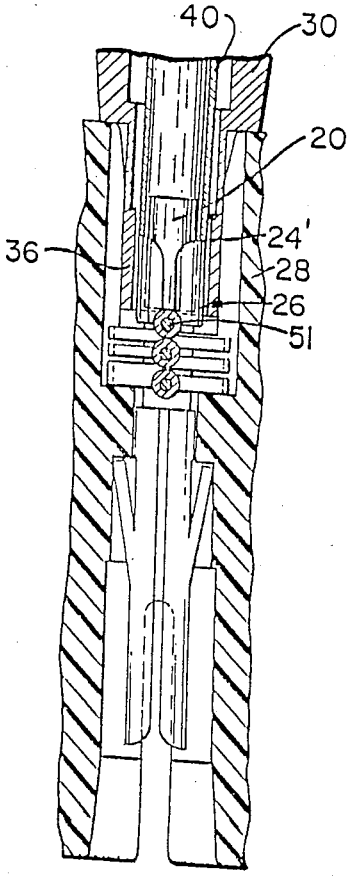
FIG. 6 is a cross-sectional view of the tool of the present invention being used to insert a wire in an insulation displacement connector of another design.

End 16 of shaft 12 is machined or otherwise formed to provide a wire insertion tip, or post, 20 which has a diameter slightly less than the inside diameter of an insulatioin displacement terminal 25 or 26, as may be seen with respect to FIGS. 5 and 6, respectively. Fixed concentrically about insertion end 16 is a sleeve member 30, which is preferably press fit to shaft 12. Fixed sleeve member 30 forms about end 16 an annularly shaped cavity 31 having a first portion 32 which opens into a second, larger cavity portion 34. The tip portion 36 of sleeve member 30 has an inside diameter which is preferably slightly greater than the outside diameter of the insulation displacement terminal and an outside diameter which is smaller than the inside diameter of the terminal housing 28. Sleeve member 30 further includes a shoulder 38 having an outside diameter greater than the inside diameter of the housing 28 to limit the penetration of the tool 10 into the housing 28 and the top of a split cylinder terminal (25 or 26).

Disposed concentrically between fixed sleeve 30 and the tip portion of shaft 12 in cavity portions 32 and 34 is a sliding sleeve 40. Sleeve 40 includes a body portion 41 disposed in cavity portion 32 and an enlarged head portion 42 which is disposed within the enlarged cavity portion 34. A spring 44 is disposed within cavity 34 and around shaft 12 and is contained between a spring stop shoulder 46 on shaft 12 and the head of sliding ejector sleeve 40, which in its normal position is stopped against an inside shoulder 48 of fixed sleeve 30.

As may be seen best with respect to FIGS. 4, 5 and 6, insulation displacement terminals 25 and 26 are double ended and supported in housings 28. The terminal design shown in FIG. 5 is shown in greater detail in the above-referenced Pohl application, while the terminal design shown in FIG. 6 is shown in detail in co-pending and commonly assigned application entitled "Multi-auge-Multiwire Insulation Displacement Terminal", filed on Oct. 21, 1985, having Ser. No. 789,482, also by Pohl. In either case, tool 10 is used to insert wires into the terminals in the following manner. First, the wire is laid across the top of the housing 28 through the radially opposite slots therein so as to lay aligned with the terminal slot. Next, the tool is inserted into the housing with sliding ejector member 40 being pushed upward by the top 24 of terminal 25 or 26 as the tip of the insertion tool extends into and around the terminal. Preferably, the tool is inserted up to the point where shoulder 38 abuts with the top of the housing 28.

The tip of the tool is sized lengthwise to push the inserted wire to a preferred position in the terminal, as illustrated by the position of wires 50 and 51 in FIGS. 5 and 6, respectively. During the insertion, the wire insulation is sliced through and displaced as the wire moves down the terminal slot and the end of the wire is trimmed off, thus generating insertion waste debris. This debris has been known to clog and jam prior art insertion tools. However, in the case of the present invention any debris which works its way up into the cavity vacated by sliding sleeve 40 during an insertion procedure is positively ejected as the tool is withdrawn after a wire insertion operation. In addition, sleeve 40 provides a barrier against wire insertion debris working up into cavity portion 34 during an insertion operation. Accordingly, the present wire insertion tool is less susceptible to jamming than prior art tools.

Assembly of tool 10 is preferably accomplished by positioning sliding sleeve 40 and spring 44 within fixed sleeve 30, and then inserting end 16 of shaft 12 therein and press fitting sleeve 30 thereto. However, it is contemplated that alternate methods of assembly or alternate structures providing the same function may be used.

An alternative embodiment of the present invention is shown in FIG. 7 which shows a handle 113 for holding a tool 10'. The handle 113 includes a slide 114 contained therein for longitudinal movement with respect to handle 113. The slide 114 includes a pin-like projection 116 formed on one end which functions as a trigger in conjunction with means for delivering an impact to the slide 114. A shoulder 117 surrounds the base of the pin-like projection 116 functioning as an anvil to receive the striking blow or impact from the means for providing the same. A cylindrical portion of slide 114 extends from shoulder 117 to a reset spring seat 118 and an inner shoulder 120 in manually engageable handle 113. Reset spring 125 urges the slide 114 outwardly from manually engageable handle 113 against inner lip 121 (shown only in FIG. 10) which limits the outward movement of slide 114. A cam follower spring retention groove 122 is formed near one end of slide 114 containing cam follower sprng 123 thereon. The slide 114 has a bore 134 formed therein with a major diameter 136 and a minor diameter 137. Bore 134 contains a shoulder 138 between major and minor diameters 136 and 137 respectively. FIG. 10 shows cam follower groove 122 containing cam follower spring 123 therein. The cam follower spring 123 extends into the major diameter 136 of bore 134 as shown in FIG. 11. In FIG. 11, cam follower spring 123 is shown traversing more than 180 degrees in cam follower spring groove 122. An extension 139 on cam follower spring 123 is seen extending through a hole 141 in the bottom of cam follower spring groove 122. Extension 139 projects into major diameter 136 in bore 134. It will be appreciated that a handle having a slide such as 114 with means for delivering a striking blow to the slide and having a cam follower spring 123 with an extension 139 extending into a bore 134 of a slide 114 as described forms no part of this invention per se and is preferably such as that shown and described in U.S. Pat. No. 4,161,061 and manufactured by Dracon Industries of Chatsworth, Calif.

The alternative embodiment of the tool of the present invention is provided with means for removably inserting a handle end of the tool and a slide 114 of handle 113. In FIGS. 7 through 11, the tool according to the alternative embodiment of the present invention is identified as 10' and elements in common with that of the previously described embodiment will have identical numeral designation with the addition of an apostrophe. In the alternative embodiment as best shown in FIGS. 9 and 10, the shaft 12' is provided with a radially extending collar 200 disposed between the wire insertion end 16' and the handle end 14'. A handle end sleeve 201 is provided having an axially extending bore 202 extending therethrough and sized to be received on handle end 14'. An end of the sleeve 201 is provided with a radially extending flange or stop 203 which abuts against collar 200 as handle end 14' is inserted into bore 202. Sleeve 201 is pressed fit onto handle end 14' with flange 203 stopping against collar 200. While this is a preferred embodiment, it will be appreciated that sleeve 201 could be integrally formed with shaft 12'.

The sleeve 201 is provided with a generally cylindrical cam engaging portion 204 sized to be received within minor diameter of bore 137. The cam engaging portion 204 or surface has a slight taper with a smallest diameter at a free end 206 with the diameter steadily increasing to a maximum diameter at a lock end 208 where the diameter at the lock end is greater than a distance between extension 139 and an opposing surface of large diameter portion 136 of bore 134. Immediately adjacent largest end 208 on a side thereof between portion 208 and stop 203, the sleeve 201 is provided with a cam follower receiving recess 210. Between recess 210 and stop 203, the sleeve 201 is provided with a collar 212 having a diameter approximately equal to a diameter of enlarged diameter 136 of bore 134. The free end 206 of the cylinder portion is provided with a bevel 216.

In operation, the tool 10' is inserted into the bore 134. As sleeve 201 is inserted into the bore 134, the cam engaging surface 204 engages the extension 139 of the spring 123. As a result, the bevel 216 rides against the surface of the smaller diameter portion 137 of bore 134. As the tool is further inserted into the bore 134, the engagement of the beveled portion 216 against the surface of the bore acts as a lever with the cam engaging surface 204 urging the extension 139 of spring 123 out of the bore through hole 141. This action continues until the sleeve 201 has been moved within the bore 134 a distance sufficient for the largest diameter portion 208 to pass the extension 139 at which point the spring action of spring 123 forces the extension 139 into the cam follower receiving recess 210. In this position, the collar 212 is snugly received within the enlarged diameter portion 136 of bore 134 and further advancement of the sleeve 201 into the bore 134 is stopped by flange 203. When so disposed within bore 134, the tool 10' is freely rotatable about its longitudinal axis with spring extension 139 received within recess 210. To remove the tool 10', the tool 10' is forced in a direction opposite the direction of insertion. When the tool 10' is forced in the opposite direction, the cam follower 139 is forced out of recess 210 by cam engaging portion 204 forcing cam follower 139 through hole 141.

It can be seen that the foregoing embodiment has numerous advantages in a tool handle such as that shown in U.S. Pat. No. 4,161,061 in that accurate radial alignment of the tool is not necessary since the entire length of the sleeve 201 provides a longitudinally extending cam surface and need not be aligned with cam follower 139. Furthermore, the extended length of the sleeve 201 provides for lever action between its free end 216 and the cam follower 139 facilitating insertion of the tool 10' into the slide 114 of handle 113.

Accordingly, although the invention has been illustrated with respect to details of its structure and function, it shall be understood that changes may be made in detail and structure without departing from the spirit and scope of the invention as set forth in the claims appended hereto.

What is claimed is:

1. A debris ejecting wire insertion tool for inserting a wire in an insulation displacement split cylinder terminal comprising:

a cylindrical shaft having a handle end and an insertion end, the tip of the insertion end of said shaft having a diameter slightly less than the inside diameter of said terminal;

a cylindrical sleeve member concentrically fixed about the insertion end of said shaft and internally sized to form an annularly shaped cavity about said tip, the tip of said sleeve having an inside diameter slightly greater than the outside diameter of said terminal;

spring biased sliding ejector sleeve means disposed between the tip of the shaft and said fixed sleeve for filling the annularly shaped cavity therebetween, and for sliding upward into said tool as it engages said terminal during an insertion operation and positively ejecting wire debris from the tool as the tool is retracted from the terminal.

2. A tool according to claim 1 comprising:

a manually engageable handle;

a slide in said handle for sliding lengthwise movement therein;

means mounted in said handle for yieldably urging said slide outwardly thereform, for limiting outward movement of said slide, and for impacting said slide;

means for removably interlocking said handle end of said cylindrical shaft and said slide including a cam follower member mounted on said slide being yieldably urged toward said handle end; a cam surface on said handle end aligned with said cam follower member so that when said cam surface is forced past said cam follower member in one direction said handle end is interlocked with said slide, and when said cam surface is forced in the opposite direction it is removable therefrom.

3. A tool according to claim 2 wherein said cam surface comprises a generally cylindrical surface on said handle end with a slight taper extending from a smallest diameter at said handle end to a largest diameter adjacent a cam follower receiving recess formed within said handle end.

4. A debris ejecting wire insertion tool for inserting a wire in an insulation displacement split cylinder terminal, comprising:

a cylindrical shaft having a handle end and an insertion end, the tip of the insertion end of said shaft having a diameter slightly less than the inside diameter of said terminal, said shaft including a spring-stop shoulder axially spaced apart from said tip;

a cylindrical sleeve member concentrically fixed about the insertion end of said shaft and internally sized to form a first annularly shaped cavity about said tip and a second annularly shaped cavity of greater diameter extending about said insertion end from said first cavity to said spring-stop shoulder, the tip of said sleeve having an inside diameter slightly greater than the outside diameter of said terminal;

a cylindrical sliding ejector sleeve concentrically disposed between the tip of the shaft and the fixed sleeve to fill the annularly shaped cavity therebetween, said sliding ejector sleeve including a head portion sized to fit within said second cavity;

a spring disposed between the head of said ejector sleeve and said spring-stop shoulder to spring bias the ejector sleeve against the shoulder formed at the junction of said first and second cavities whereby during an insertion operation the ejector sleeve engages said terminal and is pushed backwards into the tool as a wire is inserted, and whereby as the tool is retracted from the terminal wire debris is positively ejected from the tool.

5. A tool for inserting a wire in a terminal comprising:

a manually engageable handle;

a slide in said handle for sliding lengthwise movement therein;

means mounted in said handle for yieldably urging said slide outwardly therefrom, for limiting outward movement of said slide, and for impacting said slide;

a shaft having a handle end and an insertion end, the tip of the insertion end of said shaft having a diameter slightly less than the inside diameter of said terminal;

a sleeve member fixed about the insertion end of said shaft and internally sized to form a cavity about said tip, the tip of said sleeve having an inside diameter slightly greater than the outside diameter of said terminal;

spring biased sliding ejector sleeve means disposed between the tip of the shaft and said fixed sleeve for filling the cavity therebetween, and for sliding upward into said tool as it engages said terminal during an insertion operation and positively ejecting wire debris from the tool as the tool is retracted from the terminal;

means for removably interlocking said handle end and said slide including a cam follower member mounted on said slide being yieldably urged toward said handle end; a cam surface on said handle end aligned with said cam follower member so that when said cam surface is forced past said cam follower member in one direction said handle end is interlocked with said slide, and when said cam surface is forced in the opposite direction it is removable therefrom.

6. A tool according to claim 5 wherein said cam surface comprises a generally cylindrical surface on said handle end with a slight taper extending from a smallest diameter at said handle end to a largest diameter adjacent a cam follower receiving recess formed within said handle end.

7. A tool for inserting a wire in a terminal having a manually engageable handle with means defining a bore for receiving an insertion tool including a cam follower member yieldably urged into said bore; said insertion tool comprising:

a shaft having a handle end sized to be received within said bore and having a cam surface aligned with said cam follower member to interlock said handle end within said bore when said cam surface is forced past said cam follower member in one direction and to release said handle and when said cam surface is forced in the opposite direction;

said shaft having an insertion end with a free end thereof sized to be received within said terminal;

a sleeve secured to said shaft at said insertion end with opposing surfaces of said sleeve and shaft defining a cavity therebetween; a free end of said sleeve sized to have an inside diameter slightly greater than an outside diameter of said terminal;

ejector means disposed between said sleeve and said shaft to fill said cavity and for sliding movement therein with means for yieldably urging said ejector means toward said free ends.

8. A tool according to claim 7 wherein said handle end is provided with a stop collar and a generally cylindrical cam engaging portion extending therefrom and sized to be received within said bore; said portion having a slight taper with a smallest diameter adjacent a free end of said portion with diameter increasing for a surface of said portion to engage said cam follower member as said portion is forced into said bore; said portion is provided with a cam follower receiving recess adjacent said collar.

* * * * *